US010763646B2

(12) United States Patent
Shimada

(10) Patent No.: US 10,763,646 B2
(45) Date of Patent: Sep. 1, 2020

(54) SPARK PLUG

(71) Applicant: NGK SPARK PLUG CO., LTD., Nagoya-shi, Aichi (JP)

(72) Inventor: Hiroki Shimada, Nagoya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 16/373,707

(22) Filed: Apr. 3, 2019

(65) Prior Publication Data

US 2019/0312415 A1 Oct. 10, 2019

(30) Foreign Application Priority Data

Apr. 10, 2018 (JP) ..... 2018-075103

(51) Int. Cl.
*H01T 13/36* (2006.01)
*H01B 17/58* (2006.01)

(52) U.S. Cl.
CPC ..... *H01T 13/36* (2013.01); *H01B 17/583* (2013.01)

(58) Field of Classification Search
CPC ..... H01T 13/36
See application file for complete search history.

(56) References Cited

U.S. PATENT DOCUMENTS

2007/0040487 A1* 2/2007 Kyuno ..... H01T 13/20 313/141
2007/0126330 A1* 6/2007 Kuki ..... H01T 13/36 313/143
2008/0054778 A1* 3/2008 Kumagai ..... H01T 13/36 313/143
2008/0079344 A1* 4/2008 Zalud ..... H01T 13/36 313/143
2008/0238284 A1* 10/2008 Moribe ..... H01T 13/36 313/144
2008/0284304 A1 11/2008 Watanabe et al.
2009/0033194 A1* 2/2009 Jaffrezic ..... H01T 13/34 313/130
2010/0019643 A1* 1/2010 Kaiser ..... H01T 13/36 313/141
2010/0052500 A1* 3/2010 Walker, Jr. ..... H01T 13/34 313/145
2011/0181168 A1 7/2011 Nakamura et al.

FOREIGN PATENT DOCUMENTS

JP 2008-287917 A 11/2008
WO WO 2010/035717 A1 4/2010

OTHER PUBLICATIONS

Office Action issued in corresponding Japanese Patent Application No. 2018-075103 dated Feb. 25, 2020.

* cited by examiner

*Primary Examiner* — Hung V Ngo
(74) *Attorney, Agent, or Firm* — Kusner & Jaffe

(57) ABSTRACT

A spark plug having a metal shell and an insulator, wherein a stepped portion that includes a rear-end-side facing surface that retains an insulator either directly or via another member is provided at an inner periphery of a metal shell. The stepped portion includes a first convex portion that includes the rear-end-side facing surface, a second convex portion that is disposed on a front end side of the first convex portion and that is adjacent to the first convex portion, and a connection portion that connects the first convex portion and the second convex portion to each other.

4 Claims, 3 Drawing Sheets

SPARK PLUG

FIELD OF THE INVENTION

The present invention relates to a spark plug, and, in particular, to a spark plug in which an insulator is retained by a metal shell.

BACKGROUND OF THE INVENTION

International Publication No. 2010/035717 discloses, in a spark plug in which an insulator is retained by a metal shell, a technology of making a portion between the metal shell and the insulator airtight by using a metallic packing. When a load that the metal shell and the insulator apply to the packing is increased, the airtightness is increased, whereas, when the excessively deformed packing strongly compresses the insulator, the insulator breaks. In the technology of International Publication No. 2010/035717, the shape of a gap between the metal shell and the insulator is adjusted to suppress excessive deformation of the packing, so that airtightness is ensured while suppressing occurrence of cracking of the insulator.

However, in the above-described existing technology, there is a demand for increasing the airtightness between the metal shell and the insulator without excessively increasing the load when retaining the insulator by the metal shell.

SUMMARY OF THE INVENTION

The present invention is made to meet this demand. An advantage of the present invention is a spark plug that is capable of ensuring airtightness between a metal shell and an insulator while suppressing occurrence of cracking of the insulator.

In accordance with a first aspect of the present invention, there is provided a spark plug that includes an insulator that extends along an axial line from a front end side to a rear end side, and a cylindrical metal shell that is disposed on an outer peripheral side of the insulator, the metal shell including a stepped portion at an inner periphery of the metal shell, the stepped portion protruding inward in a radial direction and including a rear-end-side facing surface that retains the insulator either directly or via another member. The stepped portion includes a first convex portion that includes the rear-end-side facing surface, a second convex portion that is disposed on a front end side of the first convex portion and that is adjacent to the first convex portion, and a connection portion that connects the first convex portion and the second convex portion to each other; and when a cross section including the axial line is viewed, in a direction perpendicular to the axial line, the connection portion exists in a range where a portion of the rear-end-side facing surface that contacts the insulator or the other member is positioned.

According to the spark plug of the first aspect, in a direction perpendicular to the axial line, the connection portion that connects the first convex portion and the second convex portion of the stepped portion to each other exists within the range where the portion of the rear-end-side facing surface of the first convex portion that contacts the insulator or the other member is positioned. Therefore, when, in retaining the insulator by the metal shell, the first convex portion is subjected to a force acting towards the front end side in an axial-line direction from the insulator, a tensile stress is produced at the first convex portion along the rear-end-side facing surface, and a compression stress is produced at the first convex portion along a connection-portion-side surface adjacent to the second convex portion. As a result, it is possible to closely contact the rear-end-side facing surface with the insulator either directly or via the other member by an opposing force that is produced by elastic deformation of the first convex portion. Therefore, it is possible to ensure airtightness between the stepped portion of the metal shell and the insulator.

When the insulator is retained by the rear-end-side facing surface via the other member, since excessive deformation of the other member is suppressed by the elastic deformation of the first convex portion, it is possible to suppress occurrence of cracking of the insulator caused by the other member. When the insulator contacts the rear-end-side facing surface, since the other member does not exist, it is possible to suppress occurrence of cracking of the insulator caused by the other member.

According to a second aspect of the present invention, there is provided a spark plug as described above, wherein, in the cross section including the axial line, a length of the first convex portion on an imaginary straight line is less than a length of the second convex portion on the imaginary straight line, the imaginary straight line passing through the connection portion and extending along the axial line. Therefore, the first convex portion subjected to a force acting towards the front end side in the axial-line direction can be easily elastically deformed. As a result, since it is possible to ensure an opposing force that is produced by the elastic deformation of the first convex portion, it is possible to increase airtightness, in addition to providing the effects of the first aspect.

According to a third aspect of the present invention, there is provided a spark plug as described above, wherein, in the cross section including the axial line, a distance from the imaginary straight line, which passes through the connection portion and which extends along the axial line, to an innermost position of the second convex portion in the radial direction is greater than a distance from the imaginary straight line to an innermost position of the first convex portion in the radial direction. Therefore, a load that is applied to the connection portion by the first convex portion subjected to a force acting towards the front end side in the axial-line direction can be easily dispersed by the second convex portion. As a result, it is possible to make it less likely for the first convex portion to buckle, in addition to providing the effects of the first aspect or the second aspect.

According to a fourth aspect of the present invention, there is provide a spark plug as described above, wherein the insulator is directly retained by the rear-end-side facing surface. Since it is possible not to use the other member that is interposed between the stepped portion and the insulator, it is possible to reduce the number of components and to prevent occurrence of cracking of the insulator caused by excessive deformation of the other member, in addition to providing the effects of any one of the first to third aspects.

DETAILED DESCRIPTION OF THE INVENTION

Preferred embodiments of the present invention are described below with reference to the attached drawings.

Figure 1:
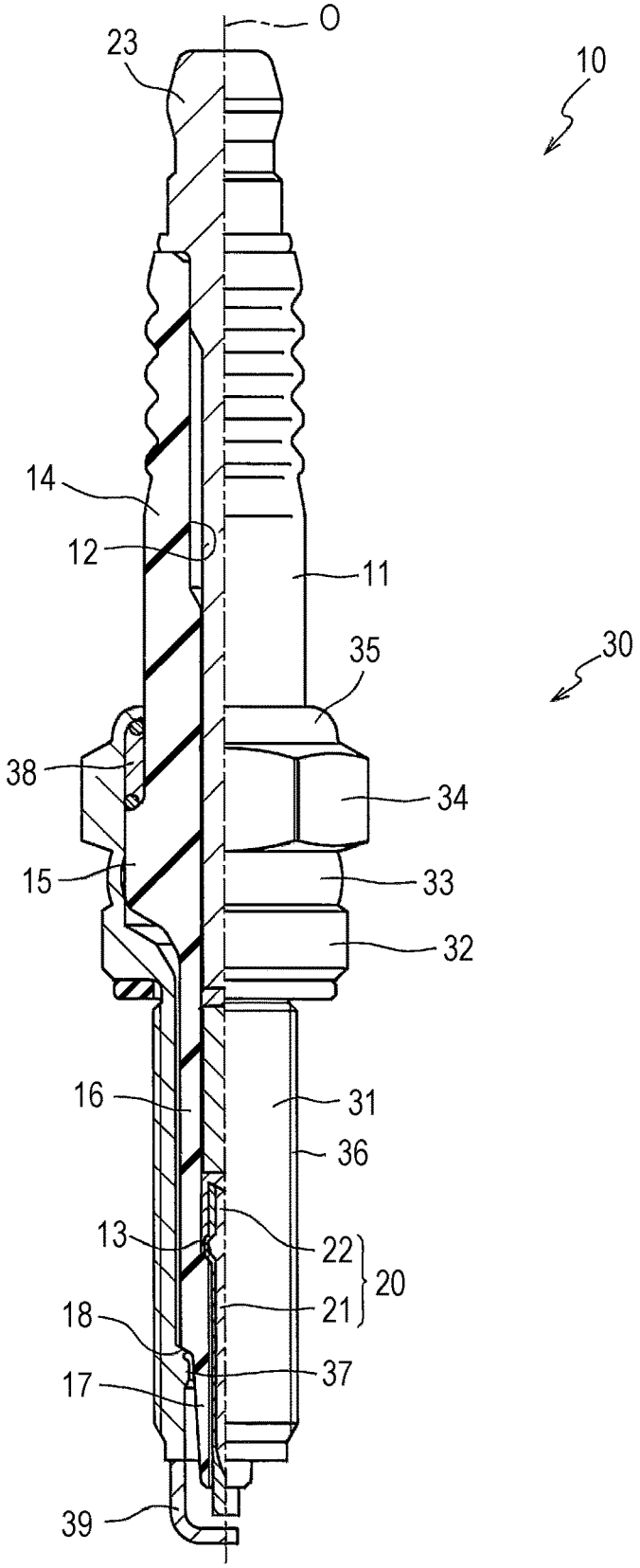
FIG. 1 is a sectional view of one side of a spark plug according to a first embodiment.

FIG. 1 is a sectional view of one side of a spark plug 10 according to a first embodiment of the present invention, with an axial line O as a boundary. In FIG. 1, a lower side in a sheet plane is called "front end side" of the spark plug 10, and an upper side in the sheet plane is called "rear end side" of the spark plug 10 (this also applies in FIGS. 2 and 3). As shown in FIG. 1, the spark plug 10 includes an insulator 11 and a metal shell 30.

The insulator 11 is a substantially cylindrical member made of, for example, alumina having excellent insulation property and mechanical property under high temperatures. An axial hole extends through the insulator 11 along the axial line O. An inclined surface 13 whose diameter decreases towards the front end side while facing the rear end side is formed on a front end side of an inner peripheral surface 12 of the insulator 11 that defines the axial hole. In the insulator 11, a rear end portion 14, a large-diameter portion 15, a small-diameter portion 16, and a front end portion 17 are formed consecutively in order from the rear end side to the front end side. The large-diameter portion 15 is a part having the largest outside diameter in the insulator 11. The small-diameter portion 16 is a part having an outside diameter than is smaller than the outside diameter of the large-diameter portion 15. The front end portion 17 having an outside diameter than is smaller than the outside diameter of the small-diameter portion 16 is adjacent to a front-end side of the small-diameter portion 16 with a retaining portion 18 interposed therebetween. The diameter of the retaining portion 18 decreases towards the front end side.

A center electrode 20 is a rod-shaped electrode that is inserted into a front end side of the axial hole and that is held by the insulator 11 along the axial line O. In the center electrode 20, a head portion 22 that protrudes axially at right angles to a shaft portion 21 extending in directions of the axial line O is formed consecutively with the shaft portion 21. The head portion 22 is retained by the inclined surface 13. In the center electrode 20, a core material having excellent thermal conductivity is embedded in a base material. The base material is formed from a metallic material containing an alloy whose main component is Ni or Ni, and the core material is formed from copper or an alloy containing copper as the main component. The core material need not be used.

A metal terminal 23 is a rod-shaped member to which a high-pressure cable (not shown) is connected, and is made of a metallic material (such as low carbon steel) having conductivity. A front end side of the metal terminal 23 is inserted into the axial hole of the insulator 11. The metal terminal 23 is electrically connected to the head portion 22 of the center electrode 20 by, for example, a conductor containing glass.

The metal shell 30 is a substantially cylindrical member made of a metallic material (such as low-carbon steel) having conductivity. The metal shell 30 includes a trunk portion 31 that surrounds a portion of the insulator 11 from the front end portion 17 to the small-diameter portion 16, a seating portion 32 that is formed consecutively with a rear end side of the trunk portion 31, a connecting portion 33 that is formed consecutively with a rear end side of the seating portion 32, a tool engaging portion 34 that is formed consecutively with a rear end side of the connecting portion 33, and a rear end portion 35 that is formed consecutively with a rear end side of the tool engaging portion 34. An external thread 36 that is screwed into a threaded hole of an engine (not shown) is formed on an outer periphery of the trunk portion 31. A stepped portion 37 that protrudes inward in a radial direction is formed along an entire inner periphery of the trunk portion 31.

The seating portion 32 is a part for covering a gap between the threaded hole of the engine (not shown) and the external thread 36, and has an outside diameter that is larger than the outside diameter of the trunk portion 31. The connecting portion 33 is a part plastically deformed into a curved shape when the metal shell 30 is mounted on the insulator 11. The tool engaging portion 34 is a part that is caused to engage with a tool, such as a wrench, when the external thread 36 is tightened in the threaded hole of the engine. The rear end portion 35 is a part bent inward in the radial direction, and is positioned on the rear end side of the large-diameter portion 15 of the insulator 11. A seal portion 38 filled with, for example, talc powder is provided between the large-diameter portion 15 and the rear end portion 35 over the entire outer periphery of the rear end portion 14 of the insulator 11.

The stepped portion 37 of the metal shell 30 is positioned on a front end side of the retaining portion 18 of the insulator 11. When the metal shell 30 is mounted on the insulator 11, a portion of the metal shell 30 from the stepped portion 37 to the rear end portion 35 of the metal shell 30 applies a compression load in a direction of the axial line O to a portion of the insulator 11 from the small-diameter portion 16 to the large-diameter portion 15 via the seal portion 38. As a result, the metal shell 30 holds the insulator 11. A ground electrode 39 is a rod-shaped metallic member (made of, for example, a nickel-based alloy) and that is joined to the trunk portion 31 of the metal shell 30. A spark gap is formed between the ground electrode 39 and the center electrode 20.

Figure 2:
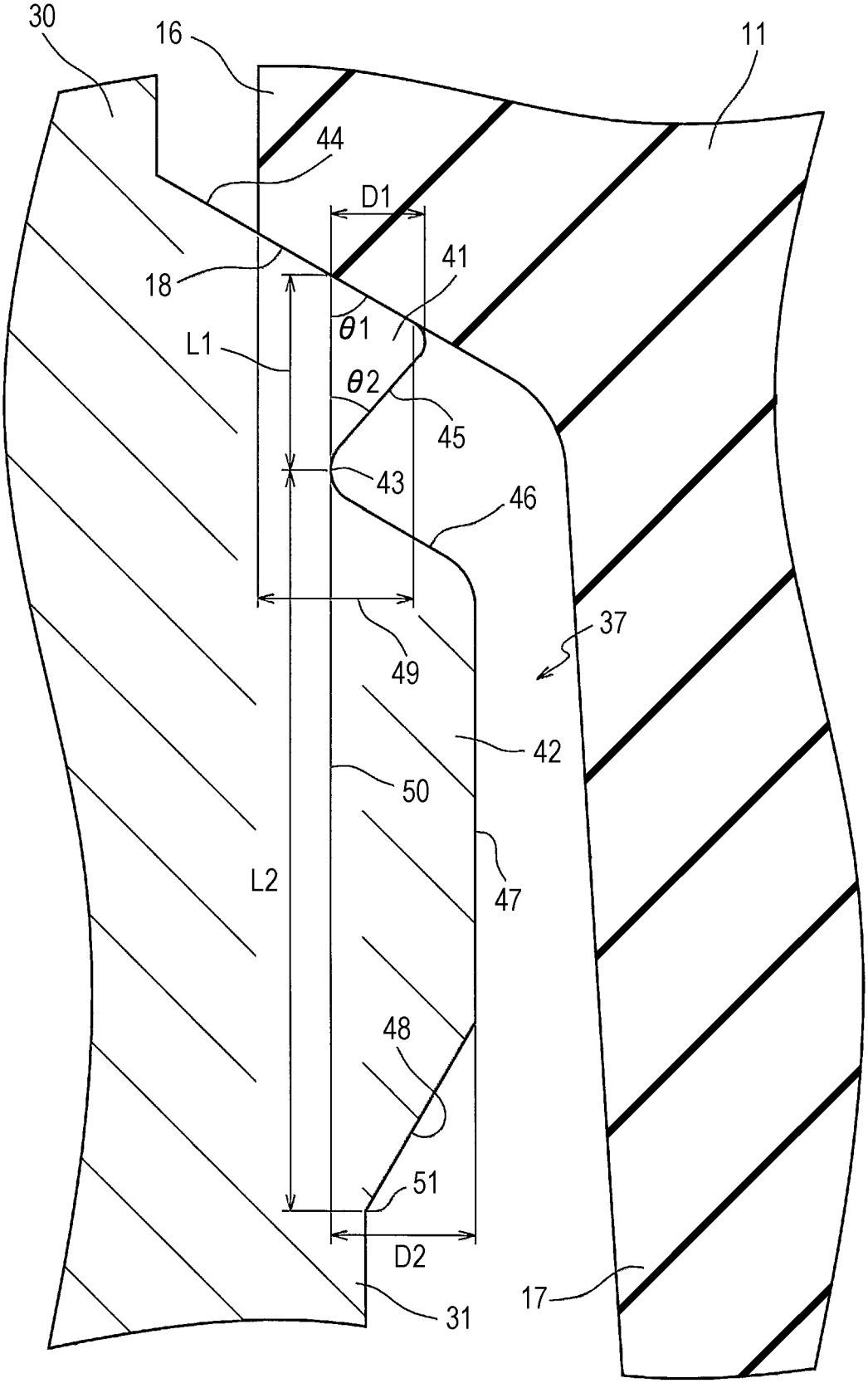
FIG. 2 is a sectional view of a part of the spark plug of FIG. 1 that is enlarged.

FIG. 2 is a sectional view of a part of the spark plug 10 of FIG. 1 (vicinity of the stepped portion 37) that is enlarged, with the axial line O (see FIG. 1) being included. The stepped portion 37 includes a first convex portion 41 that protrudes inward (towards the right in FIG. 2) in the radial direction from the trunk portion 31 of the metal shell 30 and a second convex portion 42 that protrudes inward in the radial direction from the trunk portion 31. The second convex portion 42 is adjacent to the first convex portion 41 on a front end side (lower side in FIG. 2) of the first convex portion 41. A connection portion 43 connects the first convex portion 41 and the second convex portion 42 to each other.

The first convex portion 41 includes a rear-end-side facing surface 44 and a front-end-side facing surface 45. The rear-end-side facing surface 44 faces the retaining portion 18 of the insulator 11. The rear-end-side facing surface 44 is a surface that retains the insulator 11, and has a diameter that decreases towards the front end side in a direction of the axial line O (up-down direction in FIG. 2). In the present embodiment, the rear-end-side facing surface 44 is in contact with the retaining portion 18 of the insulator 11. The front-end-side facing surface 45 is a surface formed consecutively with the connection portion 43 and has a diameter that increases towards the front end side.

At the second convex portion 42, in order from the rear end side to the front end side, a first surface 46, a second surface 47, and a third surface 48 are formed consecutively. The first surface 46 is a surface that faces the rear end side, and has a diameter that decreases towards the front end side. The second surface 47 is a surface that faces a direction perpendicular to the axial line O (towards the side of the front end portion 17 of the insulator 11). The third surface 48 is a surface that faces the front end side and has a diameter that increases towards the front end side.

The connection portion 43 is a surface that corresponds to a valley bottom that connects the front-end-side facing surface 45 of the first convex portion 41 and the first surface 46 of the second convex portion 42 to each other. In a direction perpendicular to the axial line O (left-right direction in FIG. 2), the connection portion 43 exists in a range 49 where a portion of the rear-end-side facing surface 44 that contacts the insulator 11 is positioned). In retaining the insulator 11 by the metal shell 30 and mounting the metal shell 30 on the insulator 11, when the first convex portion 41 is subjected to a force acting towards the front end side (lower side in FIG. 2) in the direction of the axial line O from the insulator 11, a tensile stress is produced at the first convex portion 41 along the rear-end-side facing surface 44, and a compression stress is produced at the first convex portion 41 along the front-end-side facing surface 45. As a result, it is possible to closely contact the rear-end-side facing surface 44 with the insulator 11 by an opposing force that acts towards the rear end side (upper side in FIG. 2) and that is produced at the first convex portion 41. Therefore, even if a load that the insulator 11 applies to the metal shell 30 is not made excessively large, it is possible to ensure airtightness between the stepped portion 37 and the insulator 11.

Since the rear-end-side facing surface 44 is made to contact the insulator 11, it is possible not to use a packing that is interposed between the stepped portion 37 and the insulator 11. It is possible to reduce the number of components in proportion to a packing that is not used and to prevent occurrence of cracking of the small-diameter portion 16 and the front end portion 17 of the insulator 11 that is caused by excessive deformation of the packing.

In the present embodiment, in a cross section including the axial line O (see FIG. 2), an angle θ1 (acute-angle side) formed by an imaginary straight line 50, which passes through the connection portion 43 and which is parallel to the axial line O, and the rear-end-side facing surface 44 is greater than an angle θ2 (acute-angle side) formed by the imaginary straight line 50 and the front-end-side facing surface 45 ($\theta 1 > \theta 2$). Therefore, compared to when $\theta 1 \leq \theta 2$, it is possible to make it less likely for the first convex portion 41 that is subjected to a force from the insulator 11 to buckle and to increase the opposing force that acts towards the rear end side and that is produced at the first convex portion 41. Consequently, it is possible to increase airtightness.

In the cross section including the axial line O, a length L1 of the first convex portion 41 on the imaginary straight line 50 is less than a length L2 of the second convex portion 42 on the imaginary straight line 50 ($L1 < L2$). Therefore, compared to when $L1 \geq L2$, the first convex portion 41 subjected to a force acting towards the front end side in the axial-line direction can be easily elastically deformed, and it is possible to ensure the opposing force that is produced by the elastic deformation of the first convex portion 41. Consequently, it is possible to increase airtightness between the first convex portion 41 and the insulator 11.

The length L1 is a length of a line segment from a point of intersection of the rear-end-side facing surface 44 and the imaginary straight line 50 to the connection portion 43. The length L2 is a length of a line segment from a point of intersection of a perpendicular line and the imaginary straight line 50 to the connection portion 43, the perpendicular line passing through a front end 51 of the third surface 48 and being perpendicular to the imaginary straight line 50. Since the connection portion 43 is in contact with the imaginary straight line 50 at one point, the length of the connection portion 43 on the imaginary straight line 50 is 0.

In the cross section including the axial line O, a distance D2 from the imaginary straight line 50 to an innermost position of the second convex portion 42 in the radial direction is greater than a distance D1 from the imaginary straight line 50 to an innermost position of the first convex portion 41 in the radial direction. Therefore, a load that is applied to the connection portion 43 by the first convex portion 41 subjected to a force acting towards the front end side in the axial-line direction can be easily dispersed by the second convex portion 42. As a result, it is possible to make it less likely for the first convex portion 41 to buckle. Further, since the connection portion 43 is rounded, compared to when the connection portion 43 is angular, it is possible to more easily disperse the load.

Since the second convex portion 42 includes the third surface 48 whose diameter increases towards the front end side, compared to when the second surface 47 is continuously formed up to a front end of the metal shell 30 without the third surface 48 existing, it is possible to ensure a gap between the trunk portion 31 and the front end portion 17. Therefore, it is possible to suppress staining of the front end portion 17 by carbon produced by, for example, incomplete combustion of an air-fuel mixture and to suppress leaks.

Since the second convex portion 42 is surrounded by the first surface 46, the second surface 47, and the third surface 48, compared to when the second surface 47 that faces inward in the radial direction does not exist (the third surface 48 is connected to the first surface 46), it is possible to increase cross-sectional second moment of the second convex portion 42. As a result, since a buckling load of the second convex portion 42 can be increased, the second convex portion 42 can be subjected to a load that the first convex portion 41 applies to the connection portion 43. Therefore, it is possible to make it less likely for the first convex portion 41 to buckle.

Figure 3:
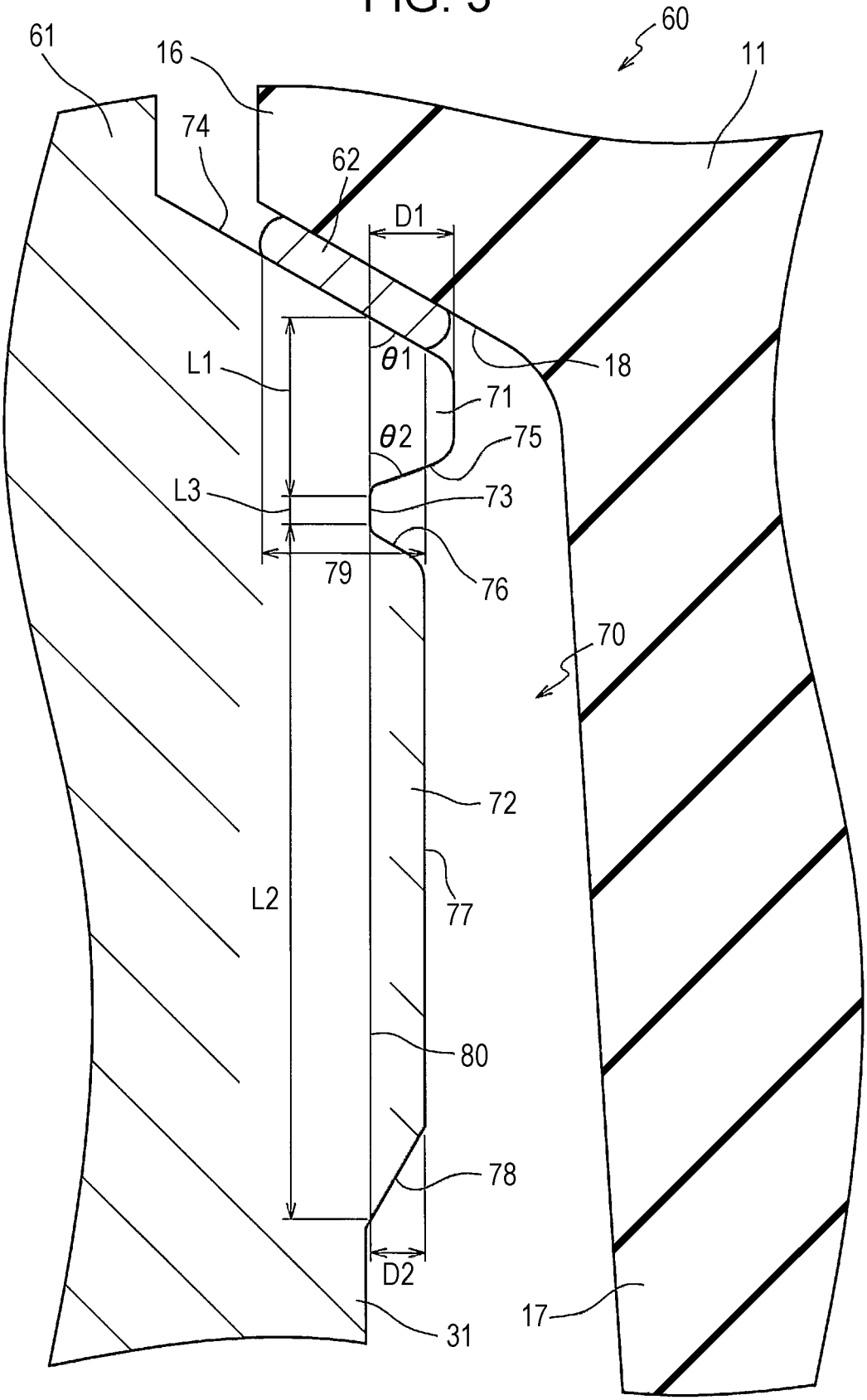
FIG. 3 is a sectional view of a spark plug according to a second embodiment.

A second embodiment is described with reference to FIG. 3. In the first embodiment, the spark plug 10 in which the insulator 11 is directly retained by the metal shell 30 is described. In contrast, in the second embodiment, a case in which an insulator 11 is retained by a metal shell 61 via a packing 62 (different member) is described. Corresponding portions to those described in the first embodiment are given the same reference numerals and are not described below. FIG. 3 is a sectional view of a spark plug 60 according to the second embodiment, with an axial line O (see FIG. 1) being included. FIG. 3 shows a portion that is similar to the portion shown in FIG. 2.

The spark plug 60 includes the insulator 11 and the metal shell 61. The metal shell 61 is a substantially cylindrical member made of a metallic material (such as low-carbon steel) having conductivity. A stepped portion 70 that protrudes inward (towards the right in FIG. 3) in a radial direction is formed along an entire inner periphery of a trunk portion 31 of the metal shell 61. The stepped portion 70 is positioned on a front end side of a retaining portion 18 of the insulator 11. The packing 62 is interposed between the retaining portion 18 and the stepped portion 70. The packing 62 is a circular-ring-shaped plate member made of a metallic material, such as a soft steel plate, that is softer than the metallic material of the metal shell 61.

When the metal shell 61 is mounted on the insulator 11, a portion of the metal shell 61 from the stepped portion 70 to a rear end portion 35 (see FIG. 1) of the metal shell 61 applies a compression load in a direction of the axial line O (up-down direction in FIG. 3) to a portion of the insulator 11 from a small-diameter portion 16 to a large-diameter portion 15 (see FIG. 1) via a seal portion 38 and the packing 62. As a result, the metal shell 61 holds the insulator 11. The packing 62 is deformed and compressed in the direction of the axial line O by the compression load.

The stepped portion 70 includes a first convex portion 71 that protrudes inward in the radial direction from the trunk portion 31 and a second convex portion 72 that protrudes inward in the radial direction from the trunk portion 31. The second convex portion 72 is adjacent to the first convex portion 71 on a front end side (lower side in FIG. 3) of the first convex portion 71. A connection portion 73 connects the first convex portion 71 and the second convex portion 72 to each other.

The first convex portion 71 includes a rear-end-side facing surface 74 and a front-end-side facing surface 75. The rear-end-side facing surface 74 faces the retaining portion 18 of the insulator 11. The rear-end-side facing surface 74 is a surface that retains the insulator 11, and has a diameter that decreases towards the front end side in a direction of the axial line O (up-down direction in FIG. 3). In the present embodiment, the rear-end-side facing surface 74 is in contact with the packing 62. The front-end-side facing surface 75 is a surface formed consecutively with the connection portion 73 and has a diameter that increases towards the front end side.

At the second convex portion 72, in order from the rear end side to the front end side, a first surface 76, a second surface 77, and a third surface 78 are formed consecutively. The first surface 76 is a surface that faces the rear end side, and has a diameter that decreases towards the front end side. The second surface 77 is a surface that faces a direction perpendicular to the axial line O (towards the side of the front end portion 17 of the insulator 11). The third surface 78 is a surface that faces the front end side and has a diameter that increases towards the front end side.

The connection portion 73 is a surface that corresponds to a valley bottom that connects the front-end-side facing surface 75 of the first convex portion 71 and the first surface 76 of the second convex portion 72 to each other. In a direction perpendicular to the axial line O (left-right direction in FIG. 3), the connection portion 73 exists in a range 79 where a portion of the rear-end-side facing surface 74 that contacts the packing 62 is positioned.

Therefore, in retaining the insulator 11 by the metal shell 61 and mounting the metal shell 61 on the insulator 11, when the first convex portion 71 is subjected to a force acting towards the front end side (lower side in FIG. 3) in a direction of the axial line O from the insulator 11, a tensile stress is produced at the first convex portion 71 along the rear-end-side facing surface 74, and a compression stress is produced at the first convex portion 71 along the front-end-side facing surface 75. As a result, it is possible to closely contact the rear-end-side facing surface 74 with the retaining portion 18 of the insulator 11 via the packing 62 by an opposing force that acts towards the rear end side (upper side in FIG. 3) and that is produced at the first convex portion 71. Therefore, even if a load that the insulator 11 applies to the metal shell 61 is not made excessively large, it is possible to ensure airtightness between the stepped portion 70 of the metal shell 61 and the insulator 11. Further, since the first convex portion 71 is elastically deformed and, thus, excessive deformation of the packing 62 is suppressed, it is possible to suppress occurrence of cracking of the small-diameter portion 16 and the front end portion 17 of the insulator 11 that is caused by the packing 62.

In the present embodiment, in a cross section including the axial line O (see FIG. 3), an angle θ1 (acute-angle side) formed by an imaginary straight line 80, which passes through the connection portion 73 and which is parallel to the axial line O, and the rear-end-side facing surface 74 is less than or equal to an angle θ2 (acute-angle side) formed by the imaginary straight line 80 and the front-end-side facing surface 75 ($\theta 1 \leq \theta 2$). Therefore, compared to when $\theta 1 > \theta 2$, it is possible to suppress an opposing force of the first convex portion 71 that is subjected to a force from the insulator 11, and to make it easier to suppress excessive deformation of the packing 62.

In the cross section including the axial line O, a length L1 of the first convex portion 71 on the imaginary straight line 80 is less than a length L2 of the second convex portion 72 on the imaginary straight line 80 ($L1 < L2$). Therefore, compared to when $L1 \geq L2$, the first convex portion 71 subjected to a force acting towards the front end side in the axial-line direction can be easily elastically deformed, and it is possible to ensure an opposing force that is produced by the elastic deformation of the first convex portion 71. Consequently, it is possible to increase airtightness between the first convex portion 71 and the insulator 11 via the packing 62.

The length L1 is a length of a line segment from a point of intersection of the rear-end-side facing surface 74 and the imaginary straight line 80 to a rear end of the connection portion 73. The length L2 is a length of a line segment from a point of intersection of the third surface 78 and the imaginary straight line 80 to a front end of the connection portion 73. The connection portion 73 is in line-contact with the imaginary straight line 80. A length L3 of the connection portion 73, which is a length of contact of the imaginary straight line 80 with the connection portion 73, is less than or equal to 0.1 mm. Since the length L3 of the connection portion 73 is less than or equal to 0.1 mm, the load that is applied to the connection portion 73 by the first convex portion 71 subjected to a force acting towards the front end side in the axial-line direction can be easily dispersed by the second convex portion 72. Therefore, it is possible to suppress buckling of the first convex portion 71.

In the cross section including the axial line O, a distance D2 from the imaginary straight line 80 to an innermost position of the second convex portion 72 in the radial direction is less than a distance D1 from the imaginary straight line 80 to an innermost position of the first convex portion 71 in the radial direction ($D1 > D2$). Therefore, compared to when $D1 \leq D2$, since a spatial distance between the second surface 77 of the second convex portion 72 and the front end portion 17 of the insulator 11 can be made long, it is possible to suppress, for example, accumulation of carbon produced by, for example, incomplete combustion of an air-fuel mixture and to make it easier to produce a predetermined spark discharge between a center electrode 20 (see FIG. 1) and a ground electrode 39.

Although the present invention has been described on the basis of the embodiments, it can be easily inferred that various improvements and modifications are possible within a scope that does not depart from the spirit of the present invention. For example, the shapes and dimensions (the distances D1 and D2 and the lengths L1, L2, and l3) of the first convex portions 41 and 71 and the second convex portions 42 and 72 are examples and are settable as appropriate.

Although, in the embodiments, the front-end-side facing surface 45 of the first convex portion 41 and the front-end-side facing surface 75 of the first convex portion 71 each have been described as having a conical shape whose diameter increases towards the front end side (circular conical surface), the front-end-side facing surfaces 45 and 75 are not necessarily limited thereto. The front-end-side facing surfaces 45 and 75 may obviously be surfaces perpendicular to the axial line O.

Although, in the embodiments, the first surface 46 of the second convex portion 42 and the first surface 76 of the second convex portion 72 each have been described as having a conical shape whose diameter decreases towards the front end side (circular conical surface), the first surfaces 46 and 76 are not necessarily limited thereto. The first surfaces 46 and 76 may obviously be surfaces perpendicular to the axial line O.

Although, in the embodiments, the second convex portions 42 and 72 have been described as including the respective second surfaces 47 and 77 (cylindrical surfaces) facing inward in the radial direction, the second convex portions 42 and 72 are not necessarily limited thereto. The third surfaces 48 and 78 may obviously be connected to the respective first surfaces 46 and 76 without using the respective second surfaces 47 and 77.

Although, in the embodiments, the third surface 48 of the second convex portion 42 and the third surface 78 of the second convex portion 72 each have been described as having a conical shape whose diameter increases towards the front end side (circular conical surface), the third surfaces 48 and 78 are not necessarily limited thereto. The third surfaces 48 and 78 may obviously be surfaces perpendicular to the axial line O.

Although, in the embodiments, the second convex portions 42 and 72 have been described as including the respective third surfaces 48 and 78, the second convex portions 42 and 72 are not necessarily limited thereto. The second surfaces 47 and 77 may obviously be continuously formed up to the front end of the metal shell 30 without using the respective third surfaces 48 and 78.

Although, in the first embodiment, a case in which the first convex portion 41 directly retains the insulator 11 has been described, the present invention is not necessarily limited thereto. As in the second embodiment, a packing 62 (another member) may obviously be interposed between the first convex portion 41 and the insulator 11. Similarly, in the second embodiment, the first convex portion 71 may obviously directly retain the insulator 11 without using the packing 62.

Although, in the embodiments, a case in which one ground electrode 39 is joined to the metal shell 30 has been described, the present invention is not necessarily limited thereto. A plurality of ground electrodes may obviously be joined to the metal shell 30.

Having described the invention, the following is claimed:

1. A spark plug, comprising:

an insulator that extends along an axial line from a front end side of the spark plug to a rear end side of the spark plug; and a cylindrical metal shell that is disposed on an outer peripheral side of the insulator, the metal shell including a stepped portion at an inner periphery of the metal shell, the stepped portion protruding inward in a radial direction, the stepped portion comprising:

a first convex portion that includes a rear-end-side facing surface, the rear-end-side facing surface facing the rear end side of the spark plug and retaining the insulator either directly or via another member;

a second convex portion that is disposed adjacent to the first convex portion on a front end side of the first convex portion, the second convex portion including a front-end-side facing surface, the front-end-side facing surface facing the front end side of the spark plug, the front-end-side facing surface having a front end that is positioned at a rear end side of a front end surface of the metal shell and a connection portion that connects the first convex portion and the second convex portion to each other, wherein, when a cross section including the axial line is viewed, in a direction perpendicular to the axial line, the connection portion exists in a range where a portion of the rear-end-side facing surface that contacts the insulator or the other member is positioned, and wherein, in the cross section including the axial line, a length of the first convex portion on an imaginary straight line is less than a length of the second convex portion on the imaginary straight line, the imaginary straight line passing through the connection portion and extending along the axial line.

2. The spark plug according to claim 1, wherein, in the cross section including the axial line, a distance from an imaginary straight line, which passes through the connection portion and which extends along the axial line, to an innermost position of the second convex portion in the radial direction is greater than a distance from the imaginary straight line to an innermost position of the first convex portion in the radial direction.

3. The spark plug according to claim 2, wherein the insulator is directly retained by the rear-end-side facing surface.

4. The spark plug according to claim 1, wherein the insulator is directly retained by the rear-end-side facing surface.

* * * * *